United States Patent [19]

Kaufman et al.

[11] Patent Number: 4,500,440

[45] Date of Patent: Feb. 19, 1985

[54] REACTION PRODUCTS OF GLYCIDYL DERIVATIZED POLYOLEFINS AND 5-AMINOTETRAZOLES AND LUBRICATING OILS CONTAINING SAME

[75] Inventors: Benjamin J. Kaufman, Wappingers Falls; Christopher S. Liu, Poughkeepsie; Rodney L. Sung, Fishkill, all of N.Y.

[73] Assignee: Texaco Inc., White Plains, N.Y.

[21] Appl. No.: 628,536

[22] Filed: Jul. 6, 1984

Related U.S. Application Data

[63] Continuation of Ser. No. 439,159, Nov. 4, 1982, abandoned.

[51] Int. Cl.[3] ..... C10M 1/32

[52] U.S. Cl. ..... 252/51.5 A; 525/331.7; 548/251

[58] Field of Search ..... 252/51.5 A; 525/331.7; 548/251

[56] References Cited

U.S. PATENT DOCUMENTS

| | | | |
|---|---|---|---|
| 3,095,402 | 6/1963 | Goldschmidt et al. | 252/51.5 A X |
| 3,364,184 | 1/1968 | Krukziener et al. | 252/51.5 A X |
| 3,879,304 | 4/1975 | Waldbillig | 252/51.5 A |
| 4,026,809 | 5/1977 | Lachowicz et al. | 252/51.5 A |
| 4,051,050 | 9/1977 | Elliott et al. | 252/51.5 A X |
| 4,194,984 | 3/1980 | Elliott et al. | 252/51.5 A |
| 4,202,783 | 5/1980 | Chibnik | 252/51.5 A |

FOREIGN PATENT DOCUMENTS 1498707 1/1978 United Kingdom .

OTHER PUBLICATIONS

API Abstracts of Refining Patents 69-5896.

Chem. Ab., vol. 82: 113793 (1975).

*Primary Examiner*—Andrew Metz

*Attorney, Agent, or Firm*—Robert A. Kulason; Robert Knox, Jr.; James J. O'Loughlin

[57] ABSTRACT

Improvements in dispersant viscosity index improvers having antioxidant properties and their use in lubricating oils are disclosed. An ethylene-propylene copolymer rubber has grafted thereon a vinyl monomer having an epoxy group to form a precursor which is condensed with a 5-aminotetrazole by ring opening of the pendent epoxide group.

8 Claims, No Drawings

REACTION PRODUCTS OF GLYCIDYL DERIVATIZED POLYOLEFINS AND 5-AMINOTETRAZOLES AND LUBRICATING OILS CONTAINING SAME

This is a continuation of application Ser. No. 439,159, filed Nov. 4, 1982 and now abandoned.

BACKGROUND OF THE INVENTION

This invention relates to novel dispersant olefin copolymeric viscosity index improves having antioxidant properties on lubricants.

Additives which retard the tendency of a lubricating oil to thin as its temperature is raised from 100° to 210° F. are known as viscosity index improvers. Such improvers include ethylene-propylene copolymers. These are single function additives and to incorporate therein dispersancy characteristics the art has suggested grafting thereon polar nitrogen-containing monomers such as C-vinylpyridines and N-vinyl pyrrolidone (U.S. Pat. No. 4,170,561). These multipurpose additives, however, do not possess antioxidant properties when incorporated in lubricants. Ease of handling and cost dictate the use of multipurpose additives capable of imparting several desirable properties to lubricants. The present invention contributes to the art a trifunctional additive.

The Prior Art

U.S. Pat. No. 2,556,075 describes glycidyl esters of acrylic, methacrylic and crotonic acids polymerized with catalytic amounts of iodine, $BF_3$, $AlCl_3$ and the like via opening of the epoxy ring.

Chem. Abs. Vol '82: 113793 (1975) reports grafting of glycidyl acrylate or methacrylate on an ethylene propylene copolymer before vulcanization. The API Abstracts of Refining Patents, 695,896, mentions the stabilization of polyolefins by grafting glycidyl acrylate or methacrylate on the polyolefin and treating the resulting precursor with acid or a thiol.

British Pat. No. 1,498,707 describes a method of chemically bonding antioxidants into polymeric materials such as an ethylene-propylene rubber by heating and reacting a mixture of the material and an antioxidant containing aliphatic unsaturation in the presence of a free radical initiator for a time sufficient to cause the antioxidant to chemically bond with the polymeric material, the antioxidant being an acylic or acyl-substituted acylic compound including various substituted methacrylates and maleimides. The resulting polymers are indicated as useful for carpet backing, solvent hoses, oil seals, O-rings and applications where the polymer is used in solution form as in fabric treatments but their use as lubricant additives is not suggested.

None of the above references are concerned with lubricant additives and do not show treatment of a VI improver-dispersant graft copolymer with a 5-amino-IH-tetrazole to obtain an additive having also antioxidant properties.

SUMMARY OF THE INVENTION

In its process aspect, the present invention is a process for making a multipurpose lubricating oil additive comprising forming a solution at a temperature of about 50° to 200° C. of an oil soluble, ethylene-propylene hydrocarbon polymer, adding an unsaturated glycidyl derivative to the solution and then a free-radical initiator in a molar ratio of derivative to initiator ranging from 1:1 to 8:1 and preferably from 2:1 to 4:1, maintaining the temperature of the solution above the decomposition temperature of the initiator for 0.25 to 5 hours; cooling the solution to room temperature; adding a 5-aminotetrazole to the solution under an inert atmosphere and heating to between 110° C. and 200° C. for 0.5 to 5 hours to form the desired product. In its composition of matter aspect, the invention is a copolymer of the general formula:

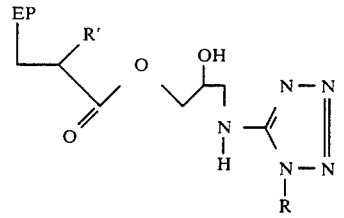

In the above, R and R' can be the same or different and are hydrogen, or inert, non-interfering groups such as (lower) alkyl, nitro, or cyano; EP represents a substantially linear, ethylene-propylene hydrocarbon copolymer containing 25 to 55 weight percent of polymerized ethylene units.

The preparative reactions are illustrated below:

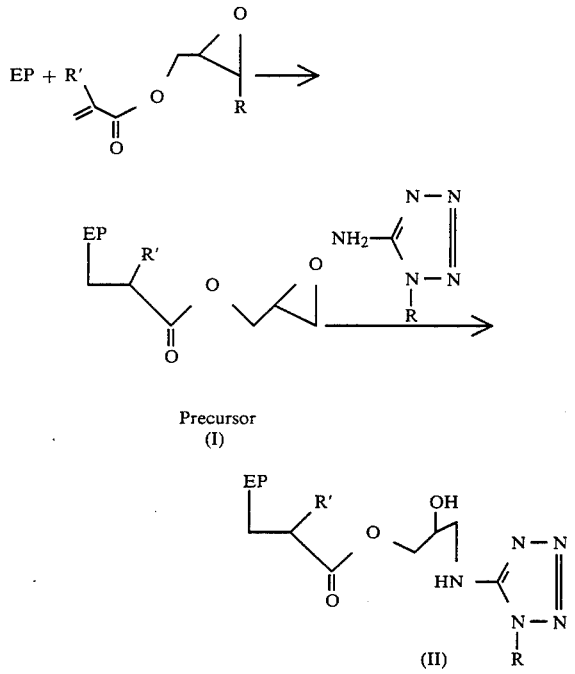

wherein R, R' and EP are as above stated.

The substrates used herein are are substantially linear, ethylene-propylene hydrocarbon copolymers containing 25 to 55 weight percent polymerized ethylene units and having a pendent index of 18 to 33, an average pendent size not exceeding 10 carbon atoms, an average chain length of 2,700 to 8,800 carbon atoms and an inherent viscosity of 0.7 to 1.8 as measured on a 0.1 weight percent solution in tetrachloroethylene at 30° C. These include soluble copolymers derived from ethylene and comonomers selected from the group consisting of terminally unsaturated straight chain monoolefins of 3 to 12 carbon atoms, -phenyl-1-alkenes of 9 to 10 carbon atoms, 2-norbornene, terminally unsaturated non-conjugated diolefins of 5 to 8 carbon atoms, dicyclopentadiene, 5-methylene-2-norbornene and mixtures thereof, that is, mixtures of the aforesaid types or subgroups, but no more than one comonomer from any single type or subgroup. Suitable terminally unsaturated straight chain monoolefins of 3 to 12 carbon atoms include propylene, 1-butene, 1-pentene, 1-hexene, 1-heptene, 1-octene, 1-nonene, 1-decene and 1-dodecene. Suitable -phenyl-1-alkenes of 9 to 10 carbon atoms are 3-phenyl-1-propene and 4-phenyl-1-butene. Suitable terminally unsaturated non-conjugated diolefins of 5 to 8 carbon atoms include 1,4-pentadiene, 1,4-hexadiene, 1,5-hexadiene, 2-methyl-1,5-hexadiene, 1,6-heptadiene and 1,7-octadiene. These copolymers are prepared as disclosed in U.S. Pat. Nos. 3,598,738 or 3,151,173. Similarly, there can be used an EP copolymer prepared in a solution of mixed isomeric hexanes and the resulting product in solution form can be used in the present process with the hexanes serving as the reaction solvent.

Any of the typical free radical initiators, such as dicumyl peroxide, dibenzoyl peroxide, di-t-butyl peroxide, azobisisobutyronitrile, diacetyl peroxide, t-butylperacetate and diisopropyl peroxydicarbonate may be employed in the present process. Preferably, they are employed in a 25 percent by weight concentration in mineral oil having an API gravity of 145 SUS at 100° F.

5-amino-IH-tetrazoles are known in the art and are commercially available. While other antioxidants are commonly used in oils, these are not bound to the polymer and as smaller molecules they tend to diffuse out from, or, around the polymer backbone and can lose their antioxidant properties.

Suitable solvents for the process can include such inert solvents as benzene, chlorobenzene and carbon tetrachloride, as well as hydrocarbon solvents such as n-hexane and mixtures of isomeric hexanes, n-heptane, dodecane and hydrocarbon mixtures including mineral oils having a viscosity at 100° F. of about 10 to 200 SUS. Polymer concentrations in such solvents may range from about 2% to 60% or higher.

The grafting reaction typically is carried out under an inert atmosphere (e.g., nitrogen) at about 50° to 200° C., preferably 60° to 160° C., for periods of 0.5 to 3 hours; reaction temperature and time are chosen according to the reactivity of the free radical initiator, lower reaction temperatures or shorter reaction times being allowed for the more reactive initiators. The grafting reaction may be carried out at atmospheric pressure or above or below atmospheric. The condensation reaction is carried out under an inert atmosphere at between 140° and 175° C. for 0.5 to 5 hours.

The product may be separated and isolated by any of the usual methods, such as precipitation with nonsolvents (e.g., acetone and isopropyl alcohol) or stripping solvent and other volatiles from the reaction mixture, and the product thus isolated may be used as the multipurpose additive; if convenient for blending purposes, the isolated polymeric product may by subsequently dissolved by blending in mineral oil, having a viscosity at 100° F. of about 10 to 160 SUS, to obtain a concentrate containing from about 5% to 60% by weight of product. Generally, the additive will be used in the range of about 0.5% to 25% by weight of the composition and preferably about 1% to 15% by weight.

The oil compositions of this invention may also contain other types of additives usually compounded into neutral oil compositions, such as pour point depressants, basic detergents, corrosion inhibitors, rust inhibitors, extreme pressure additives and in an amount effective to fulfill each additive's function therein. The copolymers used in accordance with this invention are generally compatible with these types of additives.

The following examples, illustrating the novel composition disclosed herein, are given without any intention that the invention be limited thereto.

EXAMPLE 1

A. Graft of glycidyl methacrylate onto (EPM) polymer

To a resin flask was added a 17 weight % ethylene propylene solution of EPM polymer in 145 pale oil (600 g) and after $N_2$ purge the solution was heated to 155° C. A 50 weight % solution of glycidyl methacrylate in 145 pale oil (24 g) was then added followed by a 25 weight % solution of dicumylperoxide in 145 pale oil (24 g). The mixture was kept at 160° C. for 1 hour followed by cooling to room temperature.

B. Incorporation of 5-aminotetrazole into the Graft

To the material made in part A (80 g) was added 5-amino-IH-tetrazole monohydrate (2 g) and $N_2$ purged. The mixture was then heated to 140° C. and it exothermed up to about 175° C. maximum. After 3 hours the mixture was cooled to room temperature. To insure amine incorporation, the precipitated polymer was found to contain 0.82%N thus showing nitrogen incorporation therein.

C. Performance Testing

The product of the example viscosity index improver was blended at 10 parts by weight in a SE package containing the components in Table 1. The results as compared to BVCT standards in Table 2 indicated that this material is a high performance dispersant. In addition, it is much more effective than the precursor which had only slight dispersancy.

The Bench VC dispersancy test (BVCT) determines dispersancy relative to three references which are the results from three standard blends tested along with the unknown. The numerical value of the test results decreases with an increase in effectiveness.

TABLE I

| | Parts By Wgt. |
|---|---|
| Component | |
| Solvent neutral oil A | 75.25 |
| Solvent neutral oil B | 21.64 |
| Zinc Dialkyldithiophosphate | 1.22 |
| 4,4' dinonyldiphenylamine | .39 |
| Overbased magnesium sulfonate | 1.50 |
| Silicone antifoamant | 150 PPM |
| Product | 10 |
| Analyses | |
| Viscosity Kin 40C CS | 30.4 |
| Viscosity Kin 100C CS | 5.33 |
| Pour Point, F. | +10 |
| Ash Sulfated, % D874 | 0.88 |
| Phosphorus, % X-Ray | 0.12 |
| Sulfur, % X-Ray Total | 0.32 |
| Zinc, % X-Ray | 0.13 |
| Magnesium, % | 0.15 |
| CC Simulator-18C | 1400 |

Oil A had a sp. gr. 60/60° F. of 0.858–0.868; Vis 100° F. 123–133; Pour Point 0° F. Oil B had a sp. gr. 60/60° F. of 0.871–0.887; Vis. 100° F. 325–350; Pour Point +10° F. Zinc salt is a salt of mixed alcohols—isopropanol and $P_2S_5$ product as described in U.S. Pat. No. 3,293,181. The overbased magnesium sulfonate had a TBN of 395 and is a salt of branched $C_{20}$–$C_{40}$ monoalkylbenzene sulfonic acid (MW 530–540) together with about 10% magnesium carbonate, 14% magnesium hydroxide and 4% magnesium sulfate.

TABLE II

BVCT DATA FOR 5-AMINOTETRAZOLE CONTAINING GLYCIDYL METHACRYLATE GRAFT AND THE GLYCIDYLMETHACRYLATE GRAFT

| glycidylmethacrylate graft | Standards | 5-aminotetrazole glycidylmethacrylate graft | Standards |
|---|---|---|---|
| 99.3 | 9.0/36.5/66.4 | 20.3 | 9.0/36.5/66.4 |

Proceeding as in Example 1, the following products defined by Formulas I and II, above having the substituents tabulated below are prepared using EP rubbers having an ethylene content of 25 to 55 percent:

| Example No. | R | $R^1$ |
|---|---|---|
| 2 | $CH_3$ | $CH_3$ |
| 3 | $NO_2$ | $CN_3$ |
| 4 | $C_5H_{11}$ | $C_2H_5$ |
| 5 | H | $C_4H_g$ |
| 6 | $NO_2$ | $NO_2$ |
| 7 | CN | $NO_2$ |
| 8 | H | $C_5H_{11}$ |
| 9 | $C_4H_9$ | H |
| 10 | $C_3H_7$ | $NO_2$ |

Other modes of applying the principle of the invention may be employed, change being made as regards the details described, provided the features states in any of the following claims or the equivalent of such be employed.

What is claimed is:

1. A multi-purpose lubricating oil additive prepared by grafting an oil-soluble ethylene-$C_3$ to $C_{12}$ olefin hydrocarbon copolymer containing 25 to 55 weight percent of polymerized ethylene units having an average chain length of 2700 to 8800 carbon atoms with glycidyl methacrylate in the presence of a free radical initiator to produce an intermediate reaction product and reacting said intermediate reaction product with a 5-aminotetrazole under condensation reaction conditions to produce said lubricating oil additive.

2. The additive according to claim 1 in which said 5-amino-1H-tetrazole is reacted with said intermediate reaction product at a temperature ranging between 140° and 175° C.

3. The additive according to claim 1 in which said copolymer is an ethylene-propylene copolymer.

4. A multi-purpose lubricating oil additive prepared by forming a solution of an oil-soluble ethylene-propylene hydrocarbon copolymer in an inert solvent, said copolymer containing 25 to 55 weight percent of polymerized ethylene units and having an average chain length of 2700 to 8800 carbon atoms, grafting said solution of said copolymer with glycidyl methacrylate in the presence of a free-radical initiator to produce an intermediate reaction product, and reacting said intermediate reaction product with a 5-aminotetrazole under an inert atmosphere at a temperature between 140° and 175° C. to produce said lubricating oil additive.

5. A lubricating oil composition comprising a major amount of an oil of lubricating viscosity and from about 0.5 to 25.0 weight percent of the reaction product of claim 1.

6. A lubricating oil composition comprising a major amount of an oil of lubricating viscosity and from 1.0 to 15.0 weight percent of the reaction product of claim 4.

7. An additive according to claim 1 in which said 5-aminotetrazole is represented by the formula

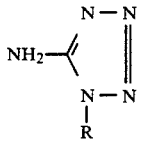

in which R is hydrogen, lower alkyl, nitro or cyano.

8. An additive according to claim 1 in which said tetrazole is 5-aminotetrazole.

* * * * *